US006042208A

United States Patent [19]

Wen

[11] Patent Number: 6,042,208

[45] **Date of Patent: *Mar. 28, 2000**

[54] IMAGE PRODUCING APPARATUS FOR MICROFLUIDIC PRINTING

[75] Inventor: Xin Wen, Rochester, N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/868,104

[22] Filed: Jun. 3, 1997

[51] Int. Cl.[7] ..... B41J 29/38

[52] U.S. Cl. ..... 347/6; 347/19

[58] Field of Search ..... 347/6, 19, 43, 347/12, 5; 395/108, 109; 346/140.1; 358/501

[56] References Cited

U.S. PATENT DOCUMENTS

| | | | |
|---|---|---|---|
| 4,614,953 | 9/1986 | Lapeyre | 347/43 |
| 5,313,291 | 5/1994 | Appel et al. | 358/501 |
| 5,585,069 | 12/1996 | Zanzucchi et al. | 422/100 |
| 5,593,838 | 1/1997 | Zanzucchi et al. | 435/6 |
| 5,603,351 | 2/1997 | Cherukuri et al. | 137/597 |
| 5,605,750 | 2/1997 | Romano et al. | 428/304.4 |
| 5,611,847 | 3/1997 | Guistina et al. | 106/20 R |

OTHER PUBLICATIONS

"Electroosmosis: A Reliable Fluid Propulsion System for Flow Injection Analysis", by Dasgupta et al; Analytical Chemistry, vol. 66, No. 11, Jun. 1, 1994, pp. 1792–1798.

*Primary Examiner*—John Barlow
*Assistant Examiner*—Charles W. Stewart, Jr.
*Attorney, Agent, or Firm*—Raymond L. Owens

[57] ABSTRACT

An image producing method and apparatus is described which, in response to a stored image file, prints a plurality of microfluidic printing pixels on a display is disclosed. The apparatus includes a plurality of ink delivery chambers, a look-up-table for converting code values corresponding to each pixel of the input image file to ink volumes to be pumped into the ink delivery chamber by microfluidic pumps, and computes the ink volumes of the inks to be pumped into each ink chamber from the code values of the corresponding pixels of the input image file. The apparatus further computes pump parameters for pumping inks of the correct volumes into each ink chamber according to the code values at each pixel of the input image file, and in response to the computed pump parameters pumps the correct amount of inks into each ink chamber, and the ink will be used to form an image pixel on the display.

6 Claims, 7 Drawing Sheets

CODE VALUES

| CVy | CVm | CVc |
|---|---|---|
| 0 | 0 | 0 |
| 1 | 0 | 0 |
| . | . | . |
| . | . | . |
| . | . | . |
| . | . | . |
| . | . | . |
| . | . | . |

INK VOLUMES IN INK MIXING CHAMBER 60

| Vy | Vm | Vc | Vk | Vcl |
|---|---|---|---|---|
| 0 | 0 | 0 | 0 | Vtotal |
| Vy1 | 0 | 0 | 0 | Vtotal-Vy1 |
| . | . | . | . | . |
| . | . | . | . | . |
| . | . | . | . | . |
| . | . | . | . | . |
| . | . | . | . | . |
| . | . | . | . | . |

FIG. 5

IMAGE PRODUCING APPARATUS FOR MICROFLUIDIC PRINTING

CROSS REFERENCE TO RELATED APPLICATIONS

Reference is made to commonly assigned U.S. patent application Ser. No. 08/699,955 filed Aug. 20, 1996 entitled "Cyan and Magenta Pigment Set"; U.S. patent application Ser. No. 08/699,962 filed Aug. 20, 1996 entitled "Magenta Ink Jet Pigment Set"; U.S. patent application Ser. No. 08/699,963 filed Aug. 20, 1996 entitled "Cyan Ink Jet Pigment Set", all by McInerney, Oldfield, Bugner, Bermel, and Santilli; U.S. patent application Ser. No. 08/790,131 filed Jan. 29, 1997 entitled "Heat Transferring Inkjet Ink Images" by Bishop, Simons, and Brick; U.S. patent application Ser. No. 08/764,379 filed Dec. 13, 1996 entitled "Pigmented Inkjet Inks Containing Phosphated Ester Derivatives" by Martin; and U.S. patent application Ser. No. 08/868,426 filed Jun. 3, 1997 entitled "Continuous Tone Microfluidic Printing" by DeBoer, Fassler, and Wen, filed concurrently herewith, assigned to the assignee of the present invention. The disclosure of these related applications is incorporated herein by reference.

FIELD OF THE INVENTION

The present invention relates to an image producing apparatus for printing digital images by microfluidic pumping of colored inks.

BACKGROUND OF THE INVENTION

Microfluidic pumping and dispensing of liquid chemical reagents is the subject of three U.S. Pat. Nos. 5,585,069; 5,593,838; and 5,603,351, all assigned to the David Sarnoff Research Center, Inc. and hereby incorporated by reference. The system uses an array of micron sized reservoirs, with connecting microchannels and reaction cells etched into a substrate. Electrokinetic pumps include electrically activated electrodes within the capillary microchannels provide the propulsive forces to move the liquid reagents within the system. The electrokinetic pump, which is also known as an electroosmotic pump, has been disclosed by Dasgupta et al, see "Electroosmosis: A Reliable Fluid Propulsion System for Flow Injection Analyses", Anal. Chem. 66, pp 1792–1798 (1994). The chemical reagent solutions are pumped from a reservoir, mixed in controlled amounts, and them pumped into a bottom array of reaction cells. The array could be decoupled from the assembly and removed for incubation or analysis. When used as a printing device, the chemical reagent solutions are replaced by dispersions of cyan, magenta, and yellow pigment, and the array of reaction cells could be considered a viewable display of picture elements, or pixels, comprising mixtures of pigments having the hue of the pixel in the original scene. When contacted with paper, the capillary force of the paper fibers pulls the dye from the cells and holds it in the paper, thus producing a paper print, or reproduction, of the original scene.

One requirement for all microfluidic printing apparatus is to reproduce a high quality image on a receiver media according to the input digital image file.

SUMMARY OF THE INVENTION

An object of this invention is to provide an image producing apparatus for microfluidic ink jet printing.

Another object of the present invention is to calibrate the print densities as a function of transferred ink volumes in microfluidic printing system.

A further object of this invention is to provide a rapid way to calculate the ink volumes for microfluidic printing based on the input image file.

These objects are achieved by an image producing apparatus responsive to stored image file having a plurality of microfluidic printing pixels on a display such as a receiver medium, comprising:

a) a plurality of ink delivery chambers;

b) a look-up-table for converting code values corresponding to each pixel of the input image file to ink volumes to be pumped into the ink delivery chamber by microfluidic pumps;

c) first computing means for computing the ink volumes of the inks to be pumped into each ink delivery chamber from the code values of the corresponding pixels of the input image file;

d) second computing means for computing pump parameters for pumping inks of the correct volumes into each ink chamber according to the code values at each pixel of the input image file; and e) means responsive to the computed pump parameters for pumping the correct amount of inks into each ink chamber, and the ink will in turn be transferred to the display to form a image pixel on the display.

ADVANTAGES

One feature of the present invention is that it provides high quality printed images based upon the code values of the pixels in the input image file.

Another feature of the invention is that it provides an effective way for producing high quality continuous tone colored images by mixing the correct amount of colored inks.

BRIEF DESCRIPTION OF THE DRAWINGS

FIG. 5 is a representative look-up table showing code values of an image file vs. ink volumes which can be used in the block 310 of FIG. 4;

DETAILED DESCRIPTION OF THE INVENTION

The present invention is described in relation to an ink jet printer that pumps colored inks using microfluidic pumps. The output images produced by such a printer can be bi-modal or continuous tone. The images printed by microfluidic printer include continuous tone images recorded from nature, but also computer generated images, graphic images, line art, text images and the like. It will also be understood that the term "colorless ink" refers to colorless or white fluids that do not absorb visible light when the colorless ink is transferred to a receiver. Although a particular receiver is described for receiving ink to produce an image, it will be understood that the term receiver includes any type of display media for receiving and producing an image.

Figure 1:
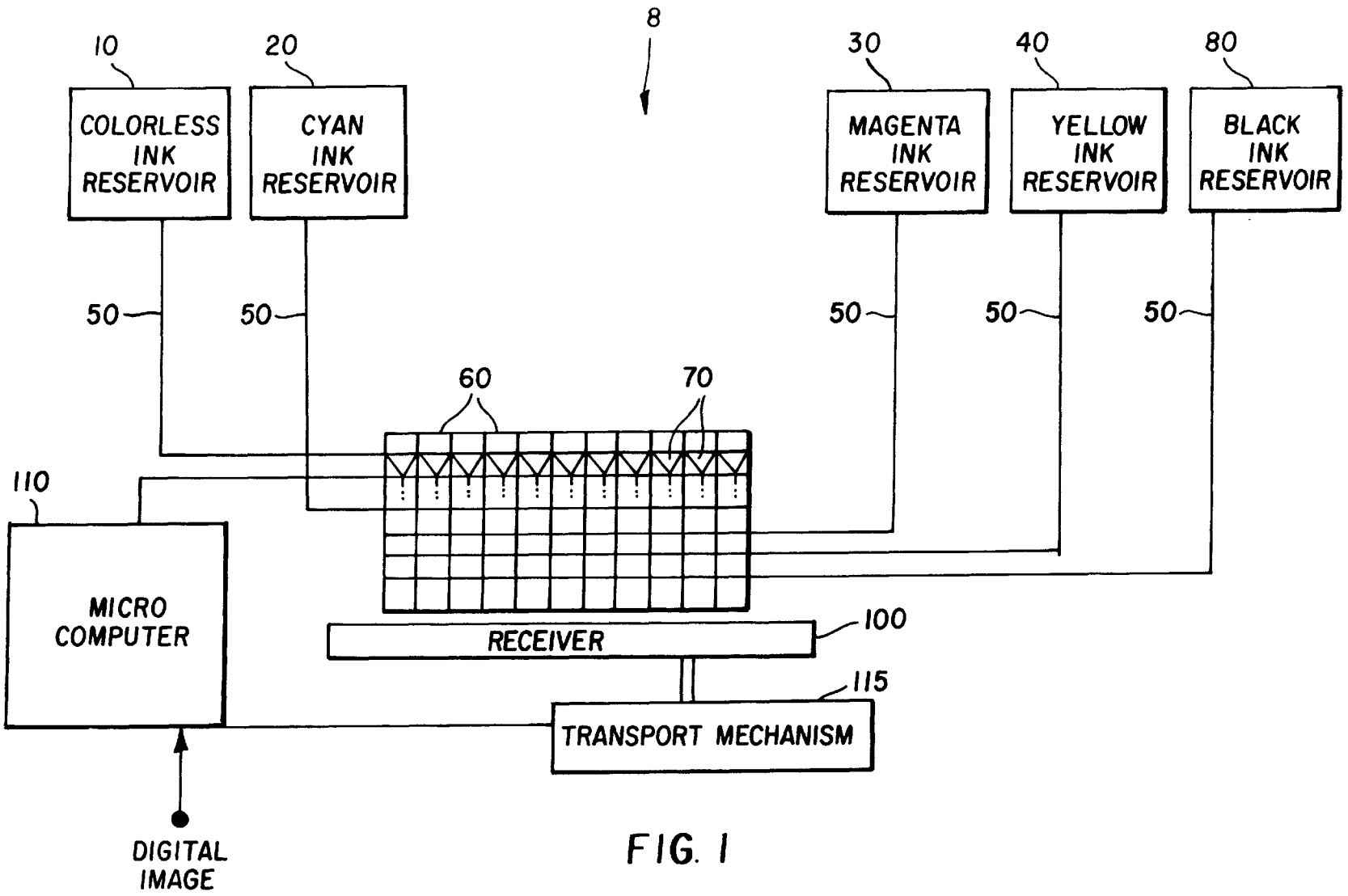
FIG. 1 is a partial schematic view showing a printing apparatus for pumping, mixing and printing pixels of ink onto a receiver.

Referring to FIG. 1, a schematic diagram is shown of a printing apparatus 8 in accordance with the present invention. Reservoirs 10, 20, 30, and 40 are respectively provided for holding colorless ink, cyan ink, magenta ink, and yellow ink. An optional reservoir 80 is shown for black ink. Microchannel capillaries 50 respectively connected to each of the reservoirs conduct ink from the corresponding reservoir to an array of ink mixing chambers 60. In the present invention, the ink mixing chambers 60 deliver the ink directly to a receiver; however, other types of ink delivery arrangements can be used such as microfluidic channels, and so when the word chamber is described, it will be understood to include those arrangements. The colored inks are delivered to ink mixing chambers 60 by electrokinetic pumps 70. The amount of each color ink is controlled by microcomputer 110 according to the input digital image. For clarity of illustration, only one electrokinetic pump 70 is shown for the colorless ink channel. Similar pumps are used for the other color channels, but these are omitted from the figure for clarity. Finally, a receiver 100 is transported by a transport mechanism to come in contact with the microfluidic printing apparatus. The receiver 100 accepts the ink and thereby produce the print.

Figure 2:
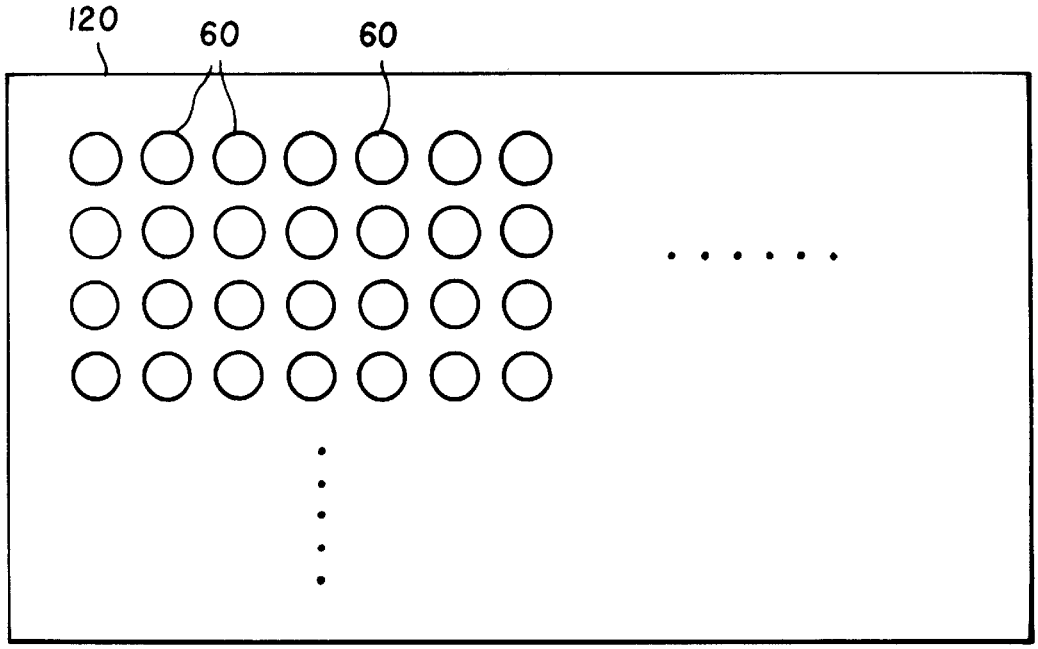
FIG. 2 is a top view of the mixing chambers in the apparatus of FIG. 1 described in the present invention.

FIG. 2 depicts a top view of an arrangement of mixing chambers 60 shown in FIG. 1. Each ink mixing chamber 60 is capable of producing a mixture of inks of different colors having any color saturation, hue, and lightness within the color gamut provided by the set of inks used in the apparatus. This results in a continuous tone photographic quality image on the receiver 100. As shown in FIG. 1, there is provided a microcomputer 110 which receives a digital image. The digital image includes a number of digital pixels which represents a continuous tone colored image. The microcomputer 110 is connected to the electrokinetic pump 70 and controls their operation. More particularly, it causes the pump to meter the correct amount of inks into each of the ink mixing chambers 60 to provide both the correct hue and tone scale for each colored pixel. Another function of the microcomputer is to arrange the array of image pixels in the proper order so the image will be right reading to the viewer. The microcomputer includes a matrix, or look-up table, which is determined experimentally, of all the colors which can be achieved by varying the mixture of inks. When a data for a particularly pixel (8 bits per color plane) is inputted, the output from the look-up table will control signals to the electrokinetic pumps to meter out the correct amount of each ink. Details of the image processing and the calculations of the pump parameters will be described below. Also provided is a transport mechanism 115 which is adapted to move the receiver 100 into and out of engagement with the ink mixing chambers 60 under the control of the microcomputer 110. After the ink mixing chambers 60 have the appropriate amount of mixed ink, the microcomputer 110 signals the transport mechanism 115 to move the receiver 100 into engagement with the ink mixing chambers 60 for ink transfer.

The colored inks used in this invention are dispersions of colorants in common solvents. Examples of such inks are found is U.S. Pat. No. 5,611,847 by Gustina, Santilli, and Bugner. Inks are also be found in the following commonly assigned U.S. patent application Ser. No. 08/699,955 filed Aug. 20, 1996 entitled "Cyan and Magenta Pigment Set"; U.S. patent application Ser. No. 08/699,962 filed Aug. 20, 1996 entitled "Magenta Ink Jet Pigment Set"; U.S. patent application Ser. No. 08/699,963 filed Aug. 20, 1996 entitled "Cyan Ink Jet Pigment Set", all by McInerney, Oldfield, Bugner, Bermel, and Santilli; and in U.S. patent application Ser. No. 08/790,131 filed Jan. 29, 1997 entitled "Heat Transferring Inkjet Ink Images" by Bishop, Simons, and Brick; and U.S. patent application Ser. No. 08/764,379 filed Dec. 13, 1996 entitled "Pigmented Wet Inks Containing Phosphated Ester Derivatives" by Martin, the disclosures of which are incorporated by reference herein. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. The colorless ink of this invention can take a number of different forms, which will suggest themselves to those skilled in the art. If the colored inks are water soluble, then the colorless ink can indeed be water.

The microchannel capillaries, ink mixing chambers 60 and electrokinetic pumps are described in the patents listed above.

The receiver 100 can be common paper having sufficient fibers to provide a capillary force to draw the ink from the mixing chambers into the paper. Synthetic papers can also be used. The receiver can have a coated layer of polymer which has a strong affinity, or mordanting effect for the inks. For example, if a water based ink is used, the colorless ink can be water, which also acts as a solvent, and a layer of gelatin will provide an absorbing layer for these mixed inks. In a preferred embodiment of the invention, an exemplary receiver is disclosed in commonly assigned U.S. Pat. No. 5,605,750 to Romano et al.

The typical printing operation in the present invention involves the following steps. First the microcomputer 110 receives a digital image or digital image file consisting of electronic signals in which the color code values are characterized by bit depths of an essentially continuous tone image, for example, 8 bits per color per pixel. Based on the color code values at each pixel in the digital image, which define the lightness, hue, and color saturation at the pixel, the microcomputer 110 operates the electrokinetic pumps to mix the appropriate amount of colored inks and colorless inks in the array of ink mixing chambers 60. Stated differently, the corresponding mixed inks in each chamber 60 are in an amount corresponding to the code values for a digital colored pixel. Details of the pump parameter calculations will be described below. The mixture of inks, which has the same Lightness, hue and color saturation as the corresponding pixel of the original image being printed, is held in the mixing chamber by the surface tension of the ink. The receiver 100 is subsequently placed by the sport mechanism 115 under the control of the microcomputer 110 in contact with the ink meniscus of the ink mixing chamber 60 within the printer front plate 120. The mixture of inks contained in the mixing chamber 60 is then drawn into the receiver by the capillary force of the paper fibers, or by the absorbing or mordanting force of the polymeric layer coated on the receiver. The receiver is peeled away from the ink mixing chambers in the printer front plate immediately after the time required to reach the full density of the print. The receiver cannot be left in contact with the front plate for too long a time or the density of the print will be higher than desired. One important advantage of the present invention is the reduction of the printing image defects that commonly occur when the cyan, magenta, and yellow inks are printed in separate operations. Misregistration of the apparatus often leads to visible misregistration of the color planes being printed. In this invention, all the color planes are printed simultaneously, thus eliminating such misregistration.

Ink from the black ink reservoir 80 can be included in the colored in mixtures to improve the density of dark areas of the print, or can be used alone to print text, or line art, if such is included in the image being printed.

Figure 3:
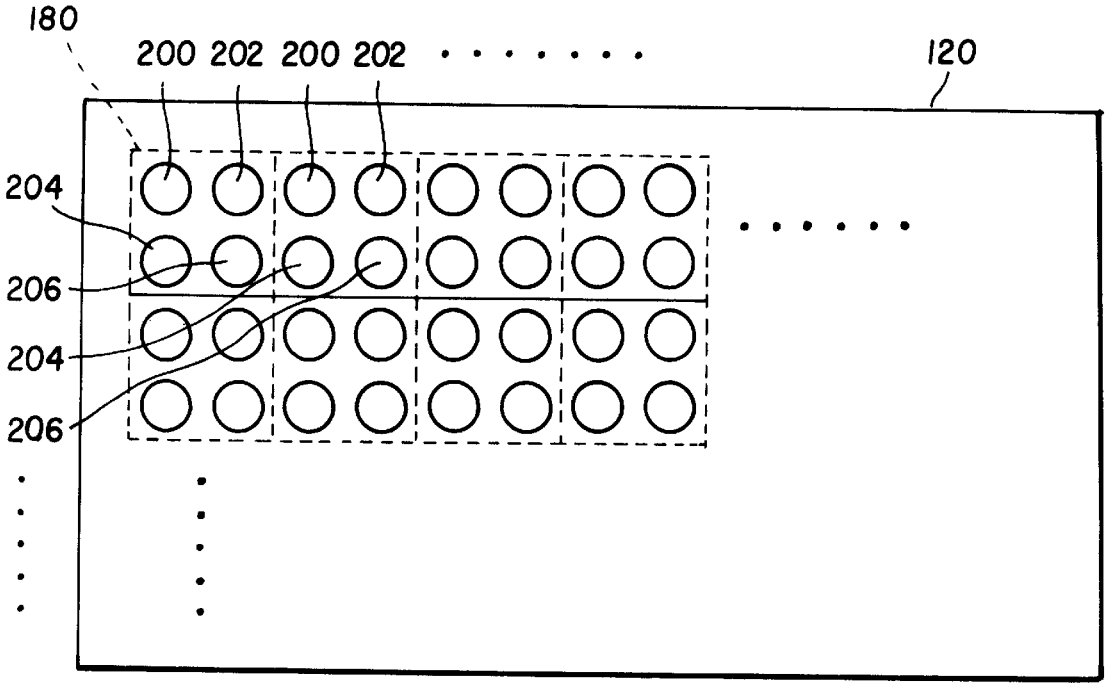
FIG. 3 is a top view of an alternate pattern of mixing chambers which can be used in the microfluidic printing apparatus of FIG. 1.

In an alternate scheme for printing with this invention, shown in FIG. 3, the ink mixing chambers 60 are divided into four groups cyan ink mixing chamber 200; magenta ink mixing chamber 202; yellow ink mixing chamber 204; and black ink mixing chamber 206. Each chamber is connected only to the respective ink color reservoir and to the colorless ink reservoir 10. For example, the cyan ink mixing chamber 200 is connected to the cyan ink reservoir and the colorless ink reservoir so that cyan inks can be mixed to any desired lightness. When the inks are transferred to the receiver 100 some of the inks can mix and blend on the receiver. Inasmuch as the inks are in distinct areas on the receiver, the size of the printed pixels should be selected to be small enough so that the human eye will integrate the color and the appearance of the image will be that of a continuous tone photographic quality image.

Within the microcomputer 110, there is an image processing algorithm which will be explained with reference to the flow chart of FIG. 4. The image file, which can be applied an input to microcomputer 110, is stored in an electronic memory block 300. Alternatively, the image file can be produced by the microcomputer 110 or provided as an input from a magnetic disk, a compact disk (CD), a memory card, a magnetic tape, a digital camera, a print scanner, or a film scanner, and the like. The image file can exist in many formats such as a page-description language or a bitmap format such as Postscript, JPEG, TIF, Photoshop, and so on. Next, the image file is processed, in block 305, which can include the following operations: decoding; decompression; rotation; resizing; coordinate transformation; mirror-image transformation (for printing on receiver media); tone scale adjustment; color management; multi-level halftoning (or multitoning); code-value conversion; rasterization; and other operations. The output image file from block 305 includes a plurality of spatial pixels described by color code values with the pixels corresponding to ink mixing chambers 60 (FIG. 2) or full color pixel 180 (FIG. 3) in the microfluidic printing system 8 (FIG. 1).

Figure 4:
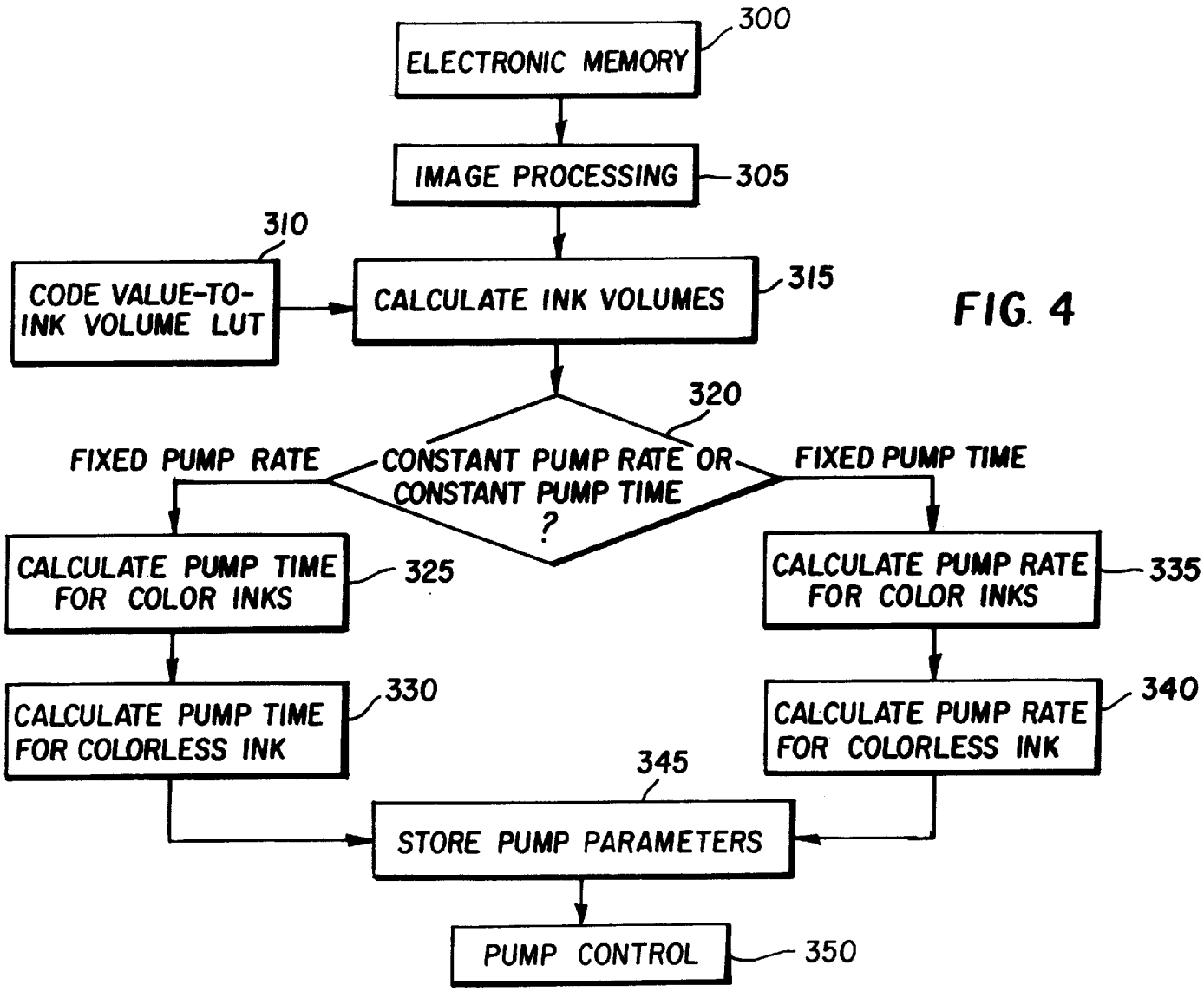
FIG. 4 is a flow diagram of the image producing algorithm used in the apparatus of FIG. 1.
Figure 6:
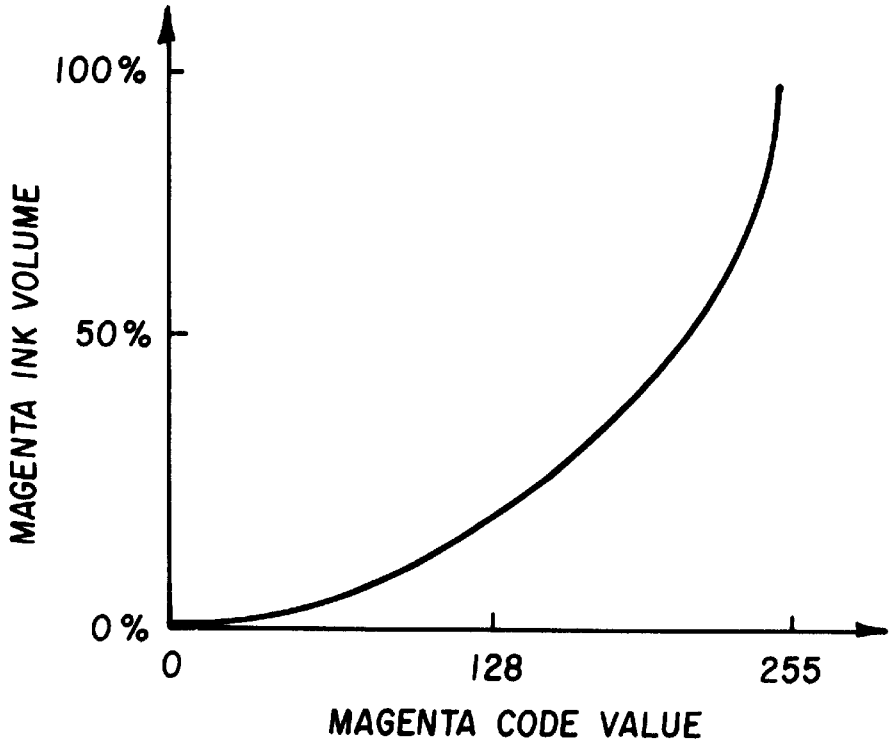
FIG. 6 is a plot of the dependence of the magenta ink volume in an ink delivery chamber as a function of the magenta code value, which is stored in the look-up table of FIG. 5.

Still referring to FIG. 4, in block 315, the ink volumes required to be pumped for each colored ink are calculated according to the code values for each spatial pixel with the assistance of a code value-to-ink volume look-up table (LUT) in block 310. A schematic illustration of the layout of the code value-to-ink volume look-up-table (LUT) in block 310 is illustrated in FIG. 5. In FIG. 5, CVy, CVm, and CVc are the code values for yellow, magenta, and cyan color planes, respectively. Vy, Vm, Vc, Vk, and Vc1 are the yellow, magenta, cyan, black, and colorless inks to be delivered to selected ink mixing chambers 60 which are related to the color code values as optimized for the best print image quality. An example of the data stored in the LUT of block 310 is shown in FIG. 6. In FIG. 6, the magenta ink volume in the ink mixing chamber 60 is plotted as a function of the magenta code value when CVy and CVy are held at zero values. The magenta code value is in a range of 8 bits and the magenta ink volume ranges from 0% to 100% of the maximum amount of magenta in a ink mixing chamber 60. (The maximum magenta ink volume is smaller than Vtotal, the total ink volume in an ink mixing chamber 60.) Detailed steps of producing the LUT in block 310 will be described below.

Again referring to FIG. 4, a question as shown in block 320 is asked whether the colored inks will be pumped at constant pump rate or constant pump time to the ink mixing chambers 60. If a constant pump rate is selected, the pump times are calculated for each colored ink connected to every ink mixing chamber 60 in block 325. For example, for ink volumes Vy, Vm, Vc required for yellow, magenta and cyan inks in an ink mixing chamber 60, the pump times are obtained by ty=Vy/Ry, tm=Vm/Rm, and tc=Vc/Rc, in which Ry, Rm, Rc are the pump rates for the yellow, magenta and cyan inks. Next, in block 330, the pump time for the colorless ink is determined. The volume of the colorless ink Vc1=Vtotal−Vy−Vm−Vc, which is normally kept at a constant for uniform ink transfer to the receiver. The pump time for the colorless ink is therefore tc1=Vc1/Rc1. If constant pump time is selected from the block 320, then the pump rates are calculated in block 335 for each colored ink connected to each ink mixing chamber 60. For example, for ink volumes Vy, Vm, Vc required for yellow, magenta and cyan inks in an ink mixing chamber 60, the pump rates are obtained by Ry=Vy/t, Rm=Vm/t, and Rc=Vc/t in which Ry, Rm, Rc are the pump rates for the yellow, magenta and cyan inks and t is the fixed pump time. Next, in block 340, the pump rate for the colorless ink is determined. The volume of the colorless ink Vc1=Vtotal−Vy−Vm−Vc, which is normally kept at a constant for uniform ink transfer to the receiver media. The pump time for the colorless ink is therefore Rc1=Vc1/t. In general, pump times and pump rates can both be varied in a microfluidic printing system and can be included in the image processing algorithm.

The pump parameters such as pump times and pump rates are stored in electronic memory in microcomputer 110 in block 345. Next, the microcomputer 110 delivers the pump parameters to the pumps to control the selected volumes of the different inks to each ink mixing chamber 60 in block 350. During the pumping procedure, the pump rates are set by the bias voltage between the electrodes in the microfluidic pumps as described in the above referenced patents and reference therein. The pump times correspond to the durations of the on-time for the microfluidic pumps, which is set by number clock cycles.

Figure 7:
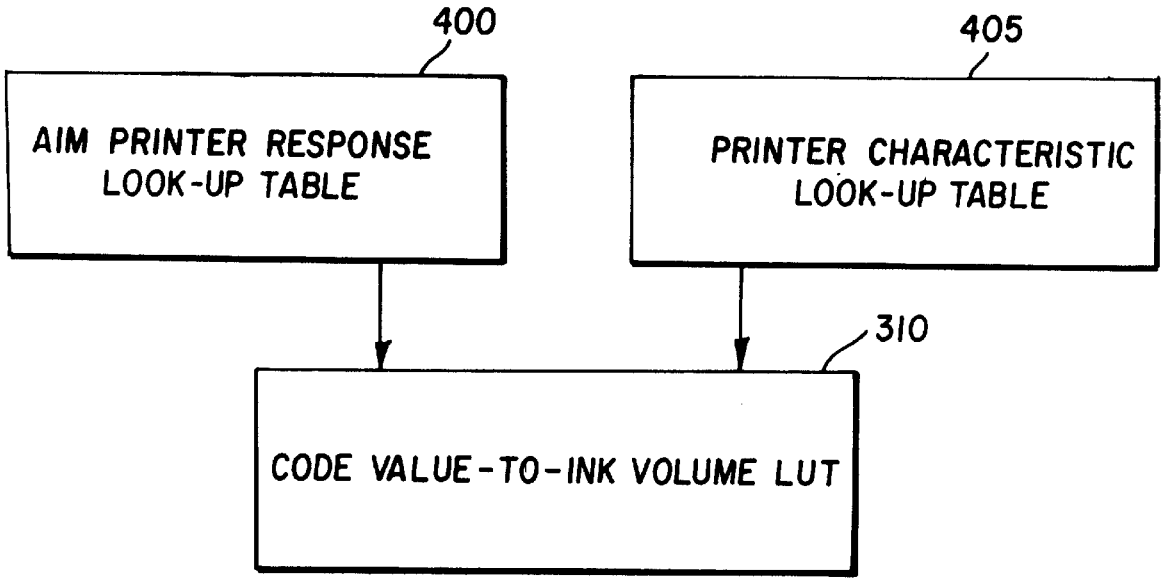
FIG. 7 is a flow chart for producing the look-up-table of block 310 of FIG. 4.
Figure 8:
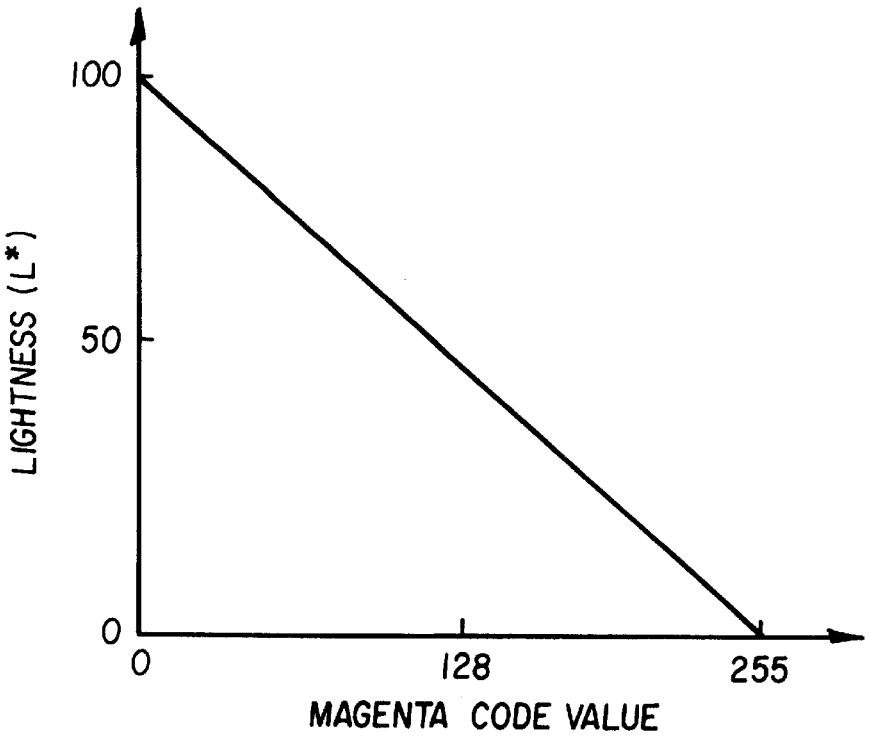
FIG. 8 is a representative plot showing the desired relationship between print lightness vs. magenta code values which is used in block 400 of FIG. 7.

Detailed steps of producing the LUT of block 310 are now described. Referring to FIG. 7, the code value-to-ink volume look-up-table in block 310, is obtained from two look-up-tables 400 and 405, respectively. The look-up table in block 400 describes the aim printer response of the microfluidic printing system 8 (FIG. 1), and the look-up table 405 is the printer characteristics look-up table. Look-up table 400 stores the desired tone and color reproduction on the printed receiver as a function of code values in the image file output from block 315 in FIG. 4. For reducing image defects such as low granularity and contouring, it is desirable to be able to print lightness (L*) levels in approximately equally spaced manner. FIG. 8 illustrates an example of the aim dependence of print lightness (0, 100), on code values in the range of (0, 255), as stored in look-up table 400. In general, L* falls in a range above 0 and below 100. Similarly, desired relationships between other code values and L* as well as color hue and saturation (a*,b*) can also be derived from look-up table 400.

Figure 9:
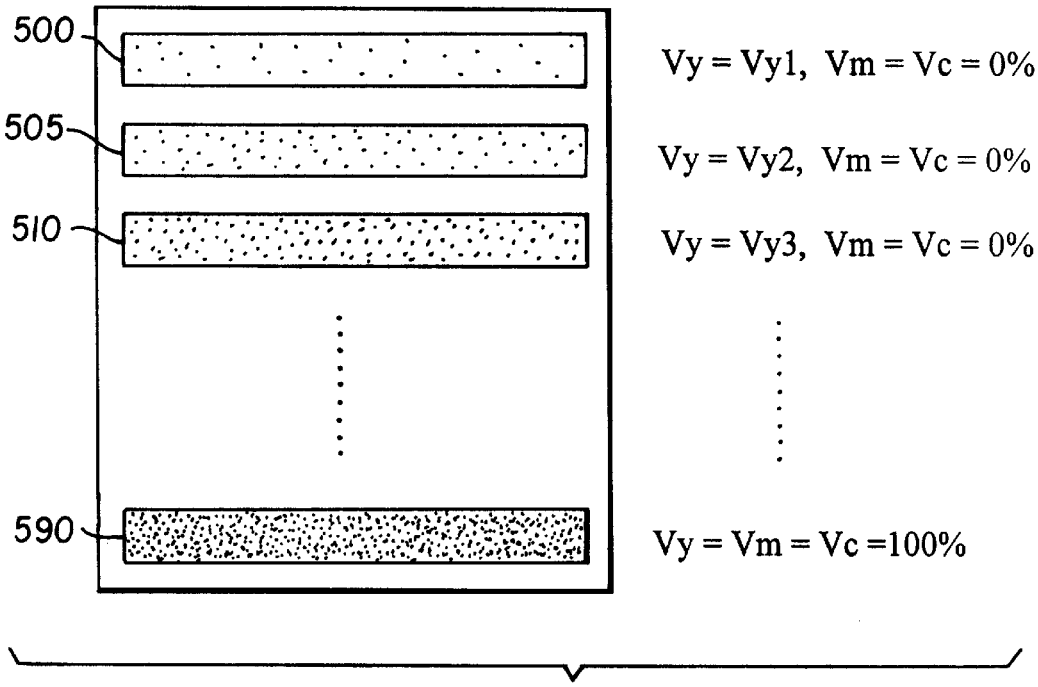
FIG. 9 shows a representative test image for calibrating printer characteristic look-up table shown as block 405 of FIG. 7.
Figure 10:
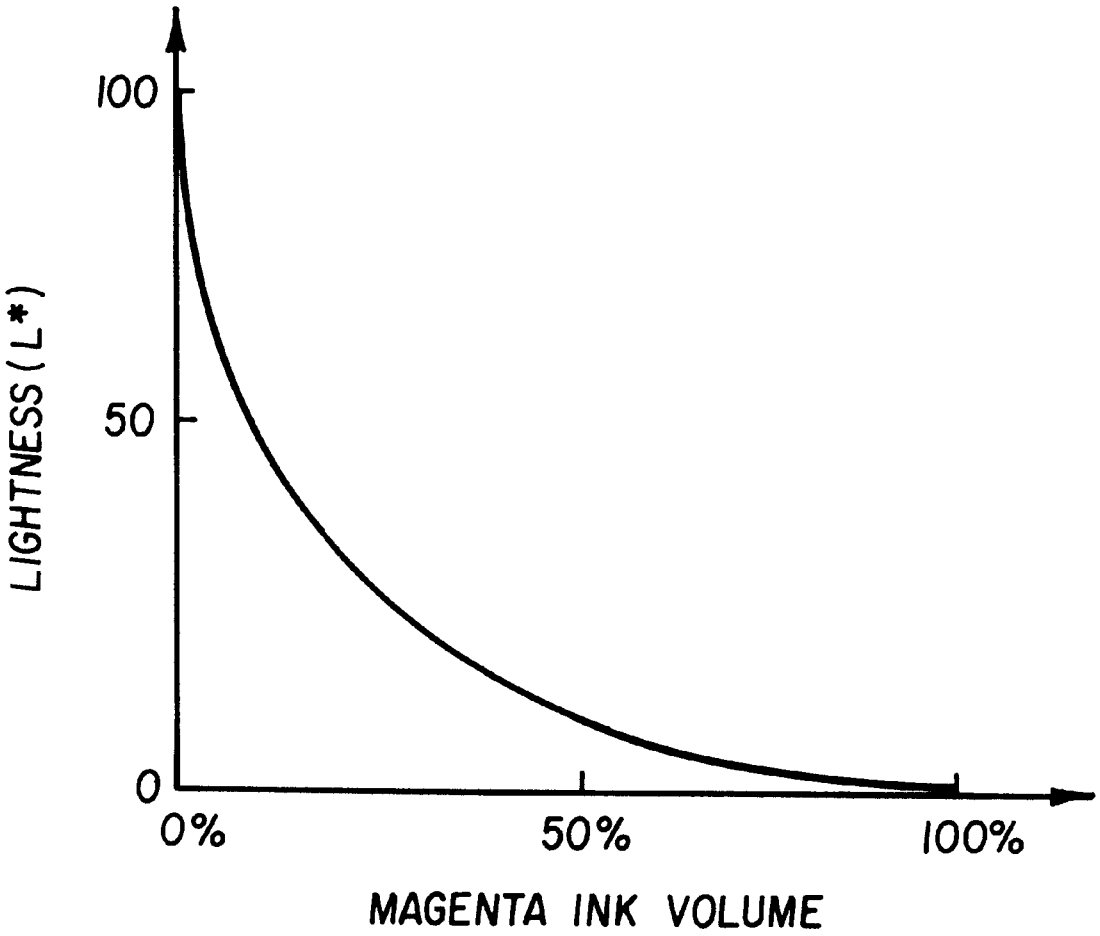
FIG. 10 is a representative printer characteristic curve of lightness vs. magenta ink volume stored in block 405 of FIG. 7.

Look-up table 405 describes the characteristic performance of the microfluidic printing system 8 (FIG. 1). It relates the ink volumes to Vy, Vm, Vc, Vk and Vc1 in the mixing chambers 60 to print properties (L*, a*, b*). Look-up table 405 is obtained by printing a test image, as illustrated in FIG. 9, comprising a plurality of uniformly distributed density patches 500,505,510 . . . 590. The ink volumes in the ink mixing chambers 60 are held at constant ratios within each of the density patches 500,505,510 . . . 590, but vary between the density patches 500,505,510 . . . 590. The color density values of the density patches 500, 505,510 . . . 590 are measured by a standard densitometer, from which L*, a*, b* values are calculated, which are used to tabulate look-up table 405 based on ink volumes.

It is also understood the techniques taught in the present invention and the above referenced and commonly assigned U.S. Application by the same author are also applicable to non-printing apparatus involving electrokinetic pumps and microfluidic devices.

The invention has been described in detail with particular reference to certain preferred embodiments thereof, but it will be understood that variations and modifications can be effected within the spirit and scope of the invention.

PARTS LIST

| | |
|---|---|
| 8 | microfluidic printing system |
| 10 | colorless ink reservoir |
| 20 | cyan ink reservoir |
| 30 | magenta ink reservoir |
| 40 | yellow ink reservoir |
| 50 | microchannel capillaries |
| 60 | ink mixing chambers |
| 70 | electrokinetic pumps |
| 80 | black ink reservoir |
| 100 | receiver |
| 110 | microcomputer |
| 115 | transport mechanism |
| 120 | printer front plate |
| 180 | full color pixel |
| 200 | cyan ink mixing chamber |
| 202 | magenta ink mixing chamber |
| 204 | yellow ink mixing chamber |
| 206 | black ink mixing chamber |
| 300 | electronic memory block |
| 305 | image processing block |
| 310 | code value to ink volume look-up table block |
| 315 | calculating ink volume block |
| 320 | constant pump rate or constant pump time |
| 325 | calculate pump time for colored inks |
| 330 | calculate pump time for colorless inks |
| 335 | calculate pump rate for colored inks |
| 340 | calculate pump rate for colorless inks |
| 345 | store pump parameters |
| 350 | pump control |
| 400 | look-up table block |
| 405 | look-up table block |
| 500 | density patch |
| 505 | density patch |
| 510 | density patch |
| 590 | density patch |

What is claimed is:

1. An image producing apparatus responsive to stored image file having a plurality of pixels on a receiver medium, comprising:

a) a plurality of ink delivery chambers;

b) a look-up-table for converting code values corresponding to each pixel of the image file to ink volumes pumped into the ink delivery chamber by microfluidic pumps;

c) first computing means for computing the ink volumes of the inks pumped into each ink delivery chamber from the code values of the corresponding pixels of the image file;

d) second computing means for computing a pump rate and a pump time for pumping inks of the correct volumes into each ink delivery chamber according to the code values at each pixel of the image file; and e) means responsive to the computed pump rate and pump time for pumping the correct amount of inks into each ink chamber so that the correct amount of ink is transferred by capillary forces of the receiver medium to form image pixels on the receiver medium.

2. An image producing apparatus responsive to stored image file having a plurality of pixels on a receiver medium by using cyan, magenta, and yellow inks, comprising:

a) a plurality of ink delivery chambers;

b) a look-up-table for converting code values corresponding to each colored pixel of the image file to ink volumes pumped into the ink delivery chamber by microfluidic pumps;

c) first computing means for computing the ink volumes of the inks pumped into each ink chamber from the code values of the corresponding pixels of the image file;

d) second computing means for computing a pump rate and a pump time for pumping inks of the correct volumes into each ink chamber according to the code values at each pixel of the image file; and e) means responsive to the computed pump rate and pump time for pumping the correct amount of inks into each ink chamber, so that the ink is transferred by capillary force of the receiver medium to form an image pixel on the receiver medium.

3. An image producing apparatus responsive to stored image file having a plurality of pixels on a receiver medium by using cyan, magenta, and yellow inks, comprising:

a) a plurality of ink mixing chambers;

b) a look-up-table for converting code values corresponding to each pixel of the image file to ink volumes pumped into the ink mixing chamber by microfluidic pumps;

c) first computing means for computing the ink volumes of the inks pumped into each ink mixing chamber from the code values of the corresponding pixels of the image file;

d) second computing means for computing pump rate and pump time for pumping inks of the correct volumes into each ink mixing chamber according to the code values at each pixel of the image file; and e) means responsive to the computed pump rate and pump time for pumping the correct amount of selected inks into each ink mixing chamber, so that the mixed ink is transferred by capillary forces of the receiver medium to the receiver to form colored image pixels on the receiver representing the image of the image file.

4. A method for producing a plurality of pixels on a receiver medium in response to stored image file, comprising:

a) calculating the ink volumes of the inks is pumped into each ink chamber in response to code values of the corresponding pixels of the image file;

b) computing pump rate and pump time for pumping inks of the correct volumes into each ink chamber according to the code values at each pixel of the image file; and c) pumping in response to the computed pump rate and pump time the correct amount of inks into each ink chamber, and the inks is transferred by capillary forces of the receiver medium to form an image pixel on the receiver medium.

5. A method for producing a plurality of pixels on a receiver medium by using cyan, magenta, and yellow inks in response to stored image file, comprising:

a) calculating ink volumes of the colored inks is pumped into each ink chamber in response to code values of the corresponding pixels of the image file;

b) computing pump rate and pump time for pumping inks of the correct volumes into each ink chamber according to the code values at each pixel of the image file; and c) pumping in response to the computed pump rate and pump time the correct amount of colored inks into each ink chamber, and the mixed ink is in turn be transferred by capillary forces of the receiver medium to form an image pixel on the receiver medium.

6. A method of producing a plurality of pixels on a receiver medium by using cyan, magenta, and yellow inks responsive to stored image file, comprising the steps of:

a) providing a plurality of ink mixing chambers;

b) converting code values corresponding to each pixel of the image file to ink volumes is pumped into the ink mixing chamber by microfluidic pumps;

c) computing the ink volumes of the inks for each ink mixing chamber from the code values of the corresponding pixels of the image file;

d) computing pump rate and pump time for pumping inks of the correct volumes into each ink mixing chamber according to the code values at each pixel of the image file; and e) pumping in response to the computed pump rate and pump time the correct amount of selected inks into each ink mixing chamber, so that the mixed ink is transferred by capillary forces of the receiver medium to the receiver to form colored image pixels on the receiver representing the image of the image file.

* * * * *

UNITED STATES PATENT AND TRADEMARK OFFICE

CERTIFICATE OF CORRECTION

PATENT : 6,042,208
DATED : March 28, 2000
INVENTOR(S) : Xin Wen

It is certified that error appears in the above-identified patent and that said Letters Patent is hereby corrected as shown below:

| | |
|---|---|
| Original Claim 4 | --4. The apparatus of claim 3 wherein the inks further include black ink.-- |
| Original Claim 5 | -- 5. The apparatus of claim 3 wherein the inks further include colorless ink for mixing with the colored inks to produce continuous tone images.-- |

Signed and Sealed this

Fifteenth Day of May, 2001

*Attest:*

Nicholas P. Godici

NICHOLAS P. GODICI

*Attesting Officer*

*Acting Director of the United States Patent and Trademark Office*